United States Patent [19]

Stahlecker

[11] Patent Number: 4,903,474

[45] Date of Patent: Feb. 27, 1990

[54] ARRANGEMENT FOR OPEN-END ROTOR SPINNING

[75] Inventor: Fritz Stahlecker, Bad Uberkingen, Fed. Rep. of Germany

[73] Assignee: Hans Stahlecker, Fed. Rep. of Germany; a part interest

[21] Appl. No.: 268,957

[22] Filed: Nov. 9, 1988

Related U.S. Application Data

[63] Continuation-in-part of Ser. No. 149,175, Jan. 27, 1988, abandoned.

[30] Foreign Application Priority Data

Feb. 13, 1987 [DE] Fed. Rep. of Germany ..... 3704460

[51] Int. Cl.[4] ..... D01H 7/882; D01H 7/892

[52] U.S. Cl. ..... 57/413; 57/415

[58] Field of Search ..... 57/404, 408, 411, 413, 57/415

[56] References Cited

U.S. PATENT DOCUMENTS

| | | | |
|---|---|---|---|
| 3,538,698 | 11/1970 | Ripka et al. | 57/413 |
| 3,651,632 | 3/1972 | Shepherd | 57/413 X |
| 3,834,138 | 9/1974 | Sakurai et al. | 57/413 |
| 3,956,876 | 5/1976 | Artzt et al. | 57/413 |
| 4,179,874 | 12/1979 | Jacobsen | 57/413 X |
| 4,245,460 | 1/1981 | Staufert et al. | 57/413 X |
| 4,459,800 | 7/1984 | Stahlecker | 57/411 |

*Primary Examiner*—John Petrakes

*Attorney, Agent, or Firm*—Barnes & Thornburg

[57] ABSTRACT

An open-end rotor spinning apparatus is provided which includes a spinning rotor element for spinning yarn. A yarn receiving surface is included with the spinning rotor element and is arranged around a spinning rotor element substantially circumferentially transverse to the axis through the spinning rotor element. A housing is provided for housing the spinning rotor element, and the housing element is connected to a vacuum source. A fiber feeding duct feeds fibers to the spinning rotor element. The fiber feeding duct includes a mouth area leading into the spinning rotor element and adjacent feeding duct. The mouth is oval shaped and has a cross-sectional width in the circumferential direction of the yarn receiving surface which is greater than the cross-sectional width in the axial direction of the spinning rotor element.

11 Claims, 2 Drawing Sheets

ARRANGEMENT FOR OPEN-END ROTOR SPINNING

BACKGROUND AND SUMMARY OF THE INVENTION

This application is a continuation-in-part application of application Ser. No. 149,175, filed Jan. 27, 1988 and now abandoned.

The invention relates to an apparatus for open-end rotor spinning having a spinning rotor that has a fiber collecting groove and a sliding surface (fiber receiving surface) that widens conically to become the fiber collecting groove. A mouth of a fiber feeding duct is directed at the sliding surface and tapers in conveying direction of the fiber.

Known apparatuses of this type include the open-end rotor spinning machine AUTOCORO v of W. Schlafhorst & Co., Machine Works, Moenchengladbach, Germany. These machines work extremely satisfactorily, and it is often desirable to increase the rotational speed to greater levels. These increased speeds are made Possible by using spinning rotors having a decreased diameter, i.e., having a collecting groove having a small diameter. Therefore, other elements of the spinning rotor must be made smaller, particularly also the sliding wall.

In order to obtain a favorable spinning result, the fibers must arrive on the sliding wall at a sufficient distance from the fiber collecting groove so that they move into the fiber collecting groove while being drawn. On the other hand, the feeding of the fibers onto the sliding wall must take place far enough from or at a substantial distance from the open edge of the spinning rotor because otherwise fibers may be taken along by the conveying air that flows off over the open edge.

Therefore, in the spinning rotors that are reduced in size, it is also provided that the mouth of the fiber feeding duct is made smaller to achieve a targeted feeding of the fibers However, this results in another problem. By reducing the size of the mouth of the fiber feeding duct, the amount of conveying air that is sucked through the fiber feeding duct is correspondingly reduced. The reduction of the amount of conveying air, that is essentially taken in via a separating opening in the area of the circumference of the opening roller, results in a collection of fly (flying) in the area of the opening roller. In order to avoid this flying it is necessary to connect a higher vacuum to the housing of the spinning rotor, which results in an increased consumption of energy and thus in a reduction of economical efficiency As object of the present invention is to provide an apparatus for open-end rotor spinning having small spinning rotors without reducing the quality of the spinning results or increasing the energy consumption.

This object is achieved by providing a fiber feeding duct having a mouth that, as viewed in the direction of a centerline through the fiber feeding duct, is larger in the circumferential direction of the spinning rotor than in the axial direction of the spinning rotor. That is, the fiber feeding duct cross section adjacent the mouth has a flattened shape as viewed in the direction of the centerline through the fiber feeding duct.

Using the apparatus, it is ensured by means of the shape of the mouth that the fibers are fed onto the sliding surface at a sufficient distance from the collecting groove, as well as at a sufficient distance from the open edge. Despite this cross-sectional shape of the mouth, all advantages of a fiber feeding duct can be achieved that tapers in conveying direction. In this case, it is endeavored that the transverse course of the mouth, i.e., the dimension in circumferential direction of the spinning rotor, is kept as small as possible. As a function of the axial course of the sliding surface of the smallest spinning rotor that is used, the width of the mouth in axial direction of the spinning rotor is dimensioned in such a way that a sufficient distance exists in the direction of the fiber collecting groove as well as of the open edge of the spinning rotor. Subsequently, as a function of the required amount of air, the width of the mouth is determined in circumferential direction of the spinning rotor.

According to advantageous features of certain preferred embodiments of the invention, it is provided that the width of the mouth in the axial direction of the spinning rotor is at most 4.5 mm. In practical preferred embodiments the width of the mouth in the circumferential direction is at least twice as great as the width of the mouth in the axial direction of the rotor. These values result in a good compromise for most uses and rotor size.

According to advantageous features of certain preferred embodiments of the invention, it is provided that the fiber feeding duct, with respect to the axis of the spinning rotor and with respect to the feeding duct centerline, has a mouth shape that is transversely oval. Using this transverse oval mouth shape, an advantageous fiber flow is obtained because the fibers as with previous arrangements are fed to the sliding surface of the spinning rotor in a predominately bundled way.

According to other advantageous features of certain preferred embodiments of the invention, it is provided that the fiber feeding duct has an at least approximately constant oval cross-section, in a plane perpendicular to the feeding duct centerline, over a length of 20 mm to 30 mm measured from its mouth. Using this type of fiber feeding duct, the fibers are fed to the sliding wall while they are bundled which is almost identical to the fiber feed achieved using a fiber feeding duct that has a round cross-section in the mouth area.

According to other advantages features of certain preferred embodiments of the invention, it is provided that the mouth wall that delimits the fiber feeding duct in the direction of the open end of the spinning rotor is arranged at a distance of about 1 mm with respect to a plane that extends through the open edge of the spinning rotor. In connection with the angle of inclination by which the fiber feeding duct is inclined with respect to a radial plane extending through the axis of the spinning rotor, a sufficient distance is therefore maintained with respect to the open edge so that a loss of fibers is safely avoided.

It is known (US-PS No. 35 38 698) to provide a fiber feeding duct between an opening roller or another opening device and a spinning rotor that has a rectangular or trapezoidal cross-section that is at least approximately constant In the case of this construction, in which the spinning rotor itself is to generate a vacuum by means of ventilation bores that are arranged in it so that the conveying air does not flow off via the open rotor edge, the mouth of the fiber feeding duct is placed in such a way that in each case one mouth edge extends in parallel to the open edge of the spinning rotor. The mouth of this fiber feeding duct is larger in circumferential direction than in axial direction of the spinning rotor. As far as it is known, an arrangement of this type has not been marketed in an actual machine The reason is probably that the duct shape leads to unsatisfactory spinning results because the fibers do not arrive at the sliding wall of the spinning rotor in a sufficient controlled way.

Other objects, advantages and novel features of the present invention will become apparent from the following detailed description of the invention when considered in conjunction with the accompanying drawings

DETAILED DESCRIPTION OF THE DRAWINGS

Figure 1:
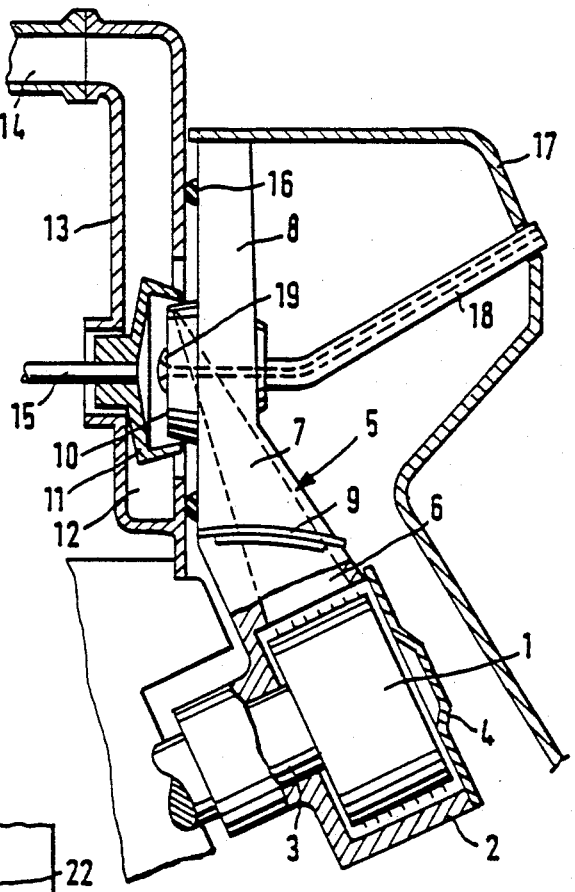
FIG. 1 is a cross-sectional view of an apparatus for open-end rotor spinning constructed according to certain preferred embodiments of the invention that is shown largely in diagram form.

The drawings show those parts of an arrangement for open-end rotor spinning that are necessary for understanding the present invention. Other parts that are not shown may correspond to certain conventional known constructions.

The shown preferred embodiment includes an opening roller 1 that is equipped with a mounting of needles or saw teeth on its circumference. The opening roller 1 is disposed in a housing 2 with a shaft 3. Towards the outside, the housing 2 is closed by a cover 4. Via a feeding device that is not shown, a sliver is fed to the opening roller 1 and is combed out by the opening roller 1, which separates the sliver into individual fibers. Under the feeding device, a separating opening is disposed in the housing 2. The separating opening is open in the direction of the circumference of the opening roller 1, and impurities of the fiber material are separated out through the separating opening.

The fibers that are separated by the opening roller 1 are fed to a spinning rotor 11 via a fiber feeding duct 5. The fiber feeding duct 5 includes a first section 6 which starts approximately tangentially with respect to the opening roller 1 in the housing 2. The first section 6 of the fiber feeding duct 5 is followed in a straight line X—X by a part 7 that is a component of a cover 8. The line X—X denotes the centerline of the straight line section of the fiber feeding duct which opens at the projection 10 of the mouth 24 in cover 8. The cover 8 is called a duct plate. The cover 8 is mounted at a movable covering 17 that can be moved away such that the spinning rotor 11 can be exposed by moving away the cover 8. Between parts 6 and 7 of the fiber feeding duct 5, a sliding joint 9 is located in which a sealing is provided so that no additional air will penetrate into the fiber feeding duct 5.

The spinning rotor 11 is arranged in a housing 12 that is connected to a vacuum pipe 14 via a connection piece 13. The spinning rotor 11 is equipped with a shaft 15 that penetrates the rear wall of the rotor housing 12 and that is disposed and driven in a way that is not shown in detail.

The cover 8 closes off the rotor housing 12 on the side of the open edge 22 of the spinning rotor 11. Between the housing 12 and the cover 8, a surrounding sealing ring 16 is arranged. The cover 8 is also provided with a projection 10 that projects into the spinning rotor 11. The projection 10 has a slightly conical shape that tapers in the direction of the rotor bottom and contains the mouth 24 of the fiber feeding duct 5 in a side wall. Concentrically with respect to the spinning rotor 11 (along rotor axis Y—Y), a yarn withdrawal nozzle 19 is provided at the projection 10 which is continued by a yarn withdrawal duct 18.

Figure 2:
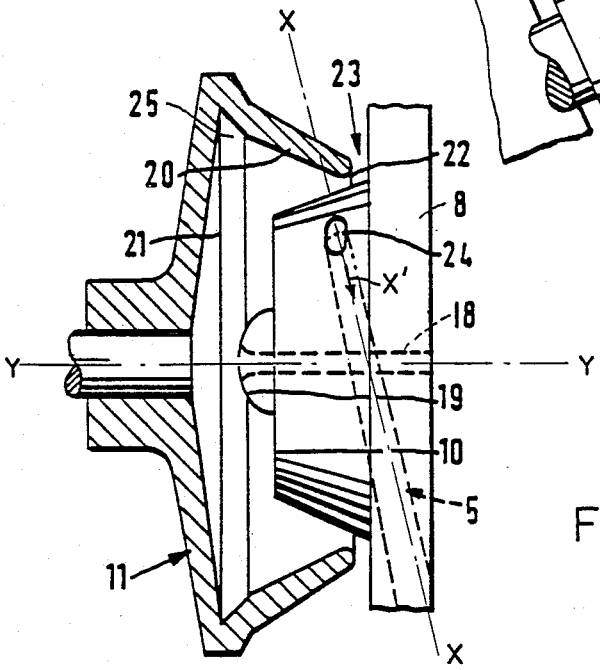
FIG. 2 is an enlarged detailed view of the apparatus according to FIG. 1.

A clearly illustrated in the enlarged representation of FIG. 2, the spinning rotor 11 has a sliding wall 20 that expands conically into a fiber collecting groove 21. As shown in FIG. 2, in the shown embodiment, the fiber collecting groove 21 has a slightly larger diameter than the inner end 25 of the sliding wall 20. The inner end 25 of the sliding wall forms an angle of 70° to 80° with respect to the radial plane of the spinning rotor 11.

During spinning, fibers are conveyed to the sliding wall 20 from the opening roller 1 in an air current, via the fiber feeding duct 5. Within the spinning rotor 11, the air current is separated from the fibers. The air current flows off to the outside via an annular gap 23 between the open edge 22 of the spinning rotor 11 and the projection 10 as well as the inner surface of the cover 8. The fibers slide on the sliding wall 20 into the fiber collecting groove 21 because of the high centrifugal force that affects them, where they are collected and bound into a yarn. The yarn is withdrawn via the withdrawal nozzle 19 and the withdrawal duct 18.

During spinning, it must be ensured that the fibers arrive on the sliding surface 20 at a sufficiently large distance from the fiber collecting groove 21, so that the fibers can slide on the sliding surface 20 such that they still experience a drawing and parallelization. In addition, it must be ensured that a sufficient speed difference exists between the arriving fibers and the arrival point of the sliding wall 20 so that the fibers are not jammed there. It must also be ensured if possible that all fibers arrive in the same area so that accidental, uneven distributions of fibers do not occur in circumferential direction of the spinning rotor 11. It must also be ensured that no fibers are sucked off through the annular gap 23, via the open edge 22 of the spinning rotor 11. The fiber feeding duct 5 has a slope with respect to a radial plane extending through the spinning rotor 11 of about 23° to 27° so that, on the one hand, the movement of the fibers has a component in the direction to the fiber collecting groove 21, but, on the other hand, are not shot directly into the fiber collecting groove 21.

In practice, it is desirable to obtain increasingly higher rotational rotor speeds and thus increasingly higher production performances. For this purpose, the diameter of the spinning rotor 11 in the area of the fiber collecting groove 21 is reduced. For high speeds, diameters for the fiber collecting groove of 36 mm and less are customary. With the reduction of the size of the spinning rotor 11 in the area of the fiber collecting grove 21, the other dimensions of the rotor 11 are also reduced, particularly also the axial course of the sliding surface 20 because otherwise the opening of the spinning rotor 11 would be too small in the area of the open edge.

Figure 3:
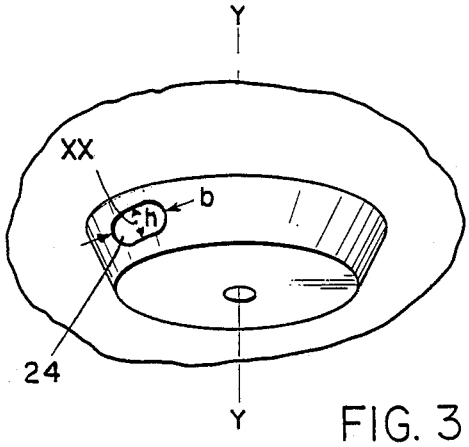
FIG. 3 is an enlarged detail view showing portions of the insert and feeding duct mouth, taken in the direction of arrow X' of FIG. 2.
Figure 4:
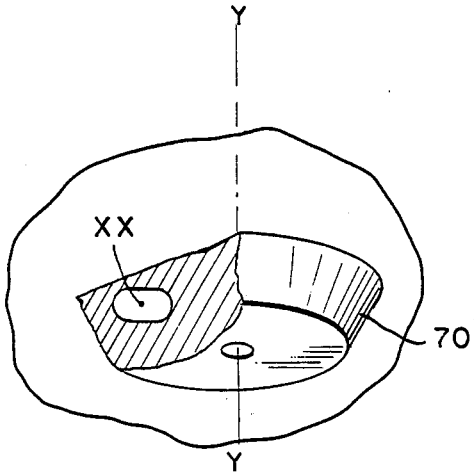
FIG. 4 is an enlarged detail view, sectioned in a plane perpendicular to the centerline of the feeding duct of FIG. 2 and located in an end portion of the feeding duct which has a similar cross-section as the feeding duct mouth.

In order to achieve perfect spinning conditions and a conveying air current flowing into the fiber feeding duct 5 that has approximately the same volume as arrangements having larger rotors despite the reduction of the sliding surface 20, it is provided that the fiber feeding duct 5 has a transversely oval mouth 24, i.e., a mouth 24 that, viewed in the direction X—X along the centerline of the feeding duct portion adjacent the mouth 24, has a larger width b in circumferential direction of the spinning rotor 11 than in the axial direction h of the spinning rotor 11 (see FIGS. 3 and 4). In certain preferred embodiments, the dimensioning of the mouth 24 includes an outlet cross-section of a magnitude of 20 $mm^2$ to 30 $mm^2$. In this case, it is provided that the width b of the mouth 24 in the axial direction of the rotor does not exceed a value of 4.5 mm. Thus, the desired cross-sectional surface is obtained by an enlargement of the mouth in the direction of its width b extending in circumferential direction of the spinning rotor 11. In preferred embodiments, width b is at least twice as large as width h.

In this case, it is provided that the opening 24 is kept as small in the rotor axial direction as it is possible on the basis of other conditions. One of these conditions is the air volume that flows in the fiber feeding duct 5 and that should not fall below a minimum value so that in the area of the opening roller 1, sufficiently high air speeds are achieved in the case of the taken in amount of air that avoids flying. In conventional dimensions, this condition is ensured if the mouth 24 of the fiber feeding duct 5 has a cross-section of about 20 $mm^2$ to about 30 $mm^2$, and a vacuum is applied to the rotor housing 12 of about 500 to 800 mm water level. Under these conditions, it is sufficient for the delimiting wall of the mouth 24 of the fiber feeding duct 5 that faces the open edge 22 of the spinning rotor 11 to maintain a distance of about 1 mm to a radial plane that extends through the open edge 22. Under the indicated conditions, it will then be ensured that no fibers are sucked off via the edge 22 of the spinning rotor 11. As also shown in FIG. 2, the projection 10 of the cover 8 is dimensioned in such a way that it maintains a relatively narrow gap with respect to the open edge 22 of the spinning rotor 11 that is in the magnitude of 1 mm to 5 mm.

As a contemplated modification of the shown embodiment, it is provided that the fiber feeding duct 5 includes an end area closest to the mouth 24 having dimensions essentially equal to the mouth 24 leading to the mouth including an essentially transversely oval shape. This end area should have a length of about 20 mm to 30 mm. The sectioned portion of FIG. 4 is taken within this length of constant cross-section. In the preceding area leading from the opening roller, the fiber feeding duct 5 tapers continuously into the constant cross-section end area. In the area of the opening roller 1, the duct 5 has a width corresponding to the width of the mouth of the opening roller 1, and the duct tapers continuously from this opening roller area into the mouth end area. Advantageously, it is provided that the fiber feeding duct 5 leading from the opening roller 1 first has a conically tapering section with an approximately circular cross-section that changes into the transversely oval last section including the transversely oval mouth 24 opposite the sliding wall 20.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open-end rotor spinning apparatus, comprising:

spinning rotor means for spinning yarn arranged on an axis;

a fiber receiving surface in said spinning rotor means which extends circumferentially around said spinning rotor axis;

housing means for housing said spinning rotor means, said housing means being connected to a vacuum source; and fiber feeding duct means for feeding fibers to said spinning rotor means, said fiber feeding duct means including a mouth area leading into said spinning rotor means where fibers exit said fiber feeding duct means as viewed in the direction of the mouth area centerline, said mouth area exhibiting a circumferential cross-sectional width in said circumferential direction of said fiber receiving surface and including an axial cross-sectional width in said axial direction of said spinning rotor means, wherein said fiber feeding duct means exhibits a cross-sectional shape in an area of the mouth which is rotationally unsymmetrical with respect to the duct centerline and with said circumferential width being greater than said axial width with respect to the duct centerline over the end portion of the length of the duct leading to the mouth area.

2. Apparatus as in claim 1, wherein said housing means includes a projection projecting into an open area of said spinning rotor means and forming a gap between said spinning rotor means and said projection, said fiber feeding duct means including a conveying air flow therethrough for conveying fibers, said gap serving as an overflow gap for said conveying air.

3. Apparatus as in claim 2, wherein said fiber feeding duct means mouth is disposed in said projection.

4. Apparatus as in claim 3, wherein said fiber feeding duct means tapers in a fiber conveying direction directed at said fiber receiving surface.

5. Apparatus as in claim 2, wherein said axial width of said fiber feeding duct means mouth is at most 4.5 mm.

6. Apparatus as in claim 2, wherein said fiber feeding duct means mouth includes an oval shape transverse to said axis of said spinning rotor means and to the centerline through the duct means adjacent the mouth.

7. Apparatus as in claim 6, wherein said fiber feeding duct means includes an approximately constant cross-section from said mouth to a plane spaced between 20 mm to about 30 mm from said mouth.

8. Apparatus as in claim 2, wherein said spinning rotor means fiber receiving surface includes an open edge adjacent said gap, said fiber feeding duct means mouth having a circumferential wall closest to said open edge and being spaced approximately 1 mm from said spinning rotor rotor means open edge.

9. Apparatus as in claim 2, wherein said vacuum source is greater than 500 mm water level.

10. Apparatus as in claim 1, wherein said duct means exhibits an oval shape adjacent to and at said mouth with respect to a centerline of said duct means adjacent to and at said mouth, and wherein said circumferential width of said oval shape mouth is at least twice the axial width of the oval shape mouth.

11. Open-end rotor spinning apparatus, comprising:

spinning rotor means for spinning yarn arranged on an axis;

a fiber receiving surface in said spinning rotor means which extends circumferentially around said spinning rotor axis;

housing means for housing said spinning rotor means, said housing means being connected to a vacuum source;

fiber feeding duct means for feeding fibers to said spinning rotor means, said fiber feeding duct means including a mouth area leading into said spinning rotor means where fibers exit said fiber feeding duct means as viewed in the direction of the mouth area centerline, said mouth area exhibiting a circumferential cross-sectional width in said circumferential direction of said fiber receiving surface and including an axial cross-sectional width in said axial direction of said spinning rotor means, said circumferential width being greater than said axial width;

wherein said housing means includes a projection projecting into an open area of said spinning rotor means and forming a gap between said spinning rotor means and said projection, said fiber feeding duct means including a conveying air flow therethrough for conveying fibers, said gap serving as an overflow gap for said conveying air; and wherein said spinning rotor means fiber receiving surface includes an open edge adjacent said gap, said fiber feeding duct means mouth having a circumferential wall closest to said open edge and being spaced approximately 1 mm from said spinning rotor means open edge.

* * * * *